US010287966B2

(12) United States Patent
Spiess et al.

(10) Patent No.: US 10,287,966 B2
(45) Date of Patent: May 14, 2019

(54) INTERNAL COMBUSTION ENGINE WITH SPLIT COOLING SYSTEM

(71) Applicant: Bayerische Motoren Werke Aktiengesellschaft, Munich (DE)

(72) Inventors: Thomas Spiess, Munich (DE); Norbert Dembinski, Munich (DE); Attila Solymosi, Munich (DE); Roy Dille, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/845,462

(22) Filed: Dec. 18, 2017

(65) Prior Publication Data

US 2018/0106181 A1 Apr. 19, 2018

Related U.S. Application Data

(63) Continuation of application No. PCT/EP2016/065962, filed on Jul. 6, 2016.

(30) Foreign Application Priority Data

Jul. 23, 2015 (DE) ..... 10 2015 213 879

(51) Int. Cl.
*F01P 7/16* (2006.01)
*F01P 3/02* (2006.01)
(Continued)

(52) U.S. Cl.
CPC ..... *F01P 7/165* (2013.01); *F01P 3/02* (2013.01); *F01P 3/12* (2013.01); *F01P 11/04* (2013.01);
(Continued)

(58) Field of Classification Search
CPC .... F01P 7/165; F01P 3/12; F01P 11/04; F01P 3/02; F01P 2003/024; F01P 2025/08; F01P 2007/146; F01P 2003/027; F01P 7/167
See application file for complete search history.

(56) References Cited

U.S. PATENT DOCUMENTS 3,521,610 A * 7/1970 Coudriet ..... F01P 7/167 123/406.7
4,288,033 A 9/1981 Wisyanski
(Continued)

FOREIGN PATENT DOCUMENTS

DE 199 38 614 A1 2/2001
DE 103 32 947 A1 2/2005
(Continued)

OTHER PUBLICATIONS

German Search Report issued in counterpart German Application No. 10 2015 213 879.8 dated Mar. 15, 2016, with partial English-language translation (Fifteen (15) pages).
(Continued)

*Primary Examiner* — Joseph J Dallo
(74) *Attorney, Agent, or Firm* — Crowell & Moring LLP

(57) ABSTRACT

An internal combustion engine, in particular for a vehicle, is provided. The internal combustion engine has a crankcase, a cylinder head, a coolant feed line, a cooling channel branching line, a first coolant channel which runs at least partly through the cylinder head, and a second coolant channel which runs at least partly through the crankcase. The coolant feed line is connected to the cooling channel branching line to supply coolant. The first and second coolant channels are each connected to the cooling channel branching line to be supplied with coolant from the cooling channel branching line. The cooling channel branching line is equipped with a temperature-sensitive current regulating
(Continued)

device which is configured to variably adjust the ratio of the coolant volumetric flow rates that are from the cooling channel branching line into the first and second coolant channels over a range on the basis of the temperature.

19 Claims, 2 Drawing Sheets

(51) Int. Cl.
*F01P 3/12* (2006.01)
*F01P 11/04* (2006.01)
*F01P 7/14* (2006.01)

(52) U.S. Cl.
CPC ..... *F01P 7/167* (2013.01); *F01P 2003/024* (2013.01); *F01P 2003/027* (2013.01); *F01P 2007/146* (2013.01); *F01P 2025/08* (2013.01)

(56) References Cited

U.S. PATENT DOCUMENTS

| | | | | |
|---|---|---|---|---|
| 5,337,704 | A | 8/1994 | Roth | |
| 6,386,150 | B1 | 5/2002 | Iwaki | |
| 2001/0035138 | A1 | 11/2001 | Fukamachi | |
| 2002/0043223 | A1* | 4/2002 | Gregory | F01P 7/16 123/41.1 |
| 2002/0069932 | A1* | 6/2002 | Watanabe | F25D 17/02 141/59 |
| 2006/0157002 | A1 | 7/2006 | Pfeffinger et al. | |
| 2008/0216776 | A1 | 9/2008 | Lemberger et al. | |
| 2011/0296834 | A1 | 12/2011 | Kuhlbach et al. | |
| 2016/0076435 | A1 | 3/2016 | Auweder et al. | |
| 2017/0298805 | A1* | 10/2017 | Kloft | F01P 3/20 |

FOREIGN PATENT DOCUMENTS

| | | | |
|---|---|---|---|
| DE | 699 18 963 | T2 | 8/2005 |
| DE | 601 29 266 | T2 | 10/2007 |
| DE | 60 2004 004 250 | T2 | 11/2007 |
| DE | 10 2010 045 217 | A1 | 3/2012 |
| DE | 10 2012 200 527 | A1 | 7/2013 |
| DE | 10 2013 209 965 | A1 | 12/2014 |
| DE | 10 2013 224 005 | A1 | 5/2015 |
| EP | 1 967 714 | A2 | 9/2008 |
| EP | 2 392 794 | A1 | 12/2011 |
| FR | 2 860 833 | A1 | 4/2005 |

OTHER PUBLICATIONS

International Search Report (PCT/ISA/210) issued in PCT Application No. PCT/EP2016/065962 dated Sep. 9, 2016 with English-language translation (Seven (7) pages).

Japanese-language Written Opinion (PCT/ISA/237) issued in PCT Application No. PCT/EP2016/065962 dated Sep. 9, 2016 (Five (5) pages).

* cited by examiner

INTERNAL COMBUSTION ENGINE WITH SPLIT COOLING SYSTEM

CROSS REFERENCE TO RELATED APPLICATIONS

This application is a continuation of PCT International Application No. PCT/EP2016/065962, filed Jul. 6, 2016, which claims priority under 35 U.S.C. § 119 from German Patent Application No. 10 2015 213 879.8, filed Jul. 23, 2015, the entire disclosures of which are herein expressly incorporated by reference.

BACKGROUND AND SUMMARY OF THE INVENTION

The present invention relates to an internal combustion engine, in particular for a vehicle, having a split cooling system, and to a vehicle having such an internal combustion engine.

In particular, internal combustion engines are known which have one cylinder, or usually have a plurality of cylinders, with pistons by way of which a crankshaft is driven, with the result that the internal combustion engine constitutes a combustion engine. Such internal combustion engines usually have what is referred to as a crank casing in which the crankshaft is mounted and in which the cylinders are at least partially formed, and a cylinder head which closes off the cylinders on one end side.

In order to cool internal combustion engines, it is also known to use cooling circuits which run through them and in which the heat which is generated in the internal combustion engine is at least partially discharged by way of a coolant which circulates in the cooling circuit. The coolant can be, in particular, water. The coolant is often also provided with additives such as, for example, an antifreeze agent.

Against this background, it is also known from the prior art to split the cooling circuit through an internal combustion engine, in particular through a combustion engine, into a plurality of secondary circuits, with the result that the flow of the coolant splits at at least one branching point into two or more separate coolant flows which serve to cool different parts of the internal combustion engine. This is often also referred to as a split cooling system.

Such an internal combustion engine with a split cooling system is described in German laid-open patent application DE 102012200527 A1. This internal combustion engine has, in one crank casing, at least three cylinders arranged in a row, a cylinder head with an inlet side and an outlet side and in each case one web region between the cylinders. In this context, a first and a second coolant duct, arranged largely parallel to a longitudinal axis of the internal combustion engine, for a coolant are provided for the cylinder head and/or the crank casing. The first and second coolant ducts are connected to each other in a coolant-conducting fashion through at least one web-drilled hole. The coolant flow in the first coolant duct is split at a plurality of branching points into partial cooling circuits which run parallel to one another and are combined again in the second coolant duct. In this context, a flow cross-section of the first coolant duct in the direction of flow of the coolant is smaller, and a flow cross-section of the second coolant duct in the direction of flow of the coolant is larger, as a result of which essentially uniformly efficient cooling and therefore distribution of temperature in the internal combustion engine along its longitudinal axis can be achieved.

A further combustion engine with an engine block and a cylinder head as well as with a split cooling system is described in patent document U.S. Pat. No. 5,337,704. The cooling system has a first cooling duct which is formed in the cylinder head and which is adjoined by a coolant line with a branching junction which splits the cooling system into two cooling branches. One of these two cooling branches leads into a second cooling duct which is formed in the engine block. A thermostat which opens only above a specific temperature threshold and permits a flow of coolant into the second cooling duct is provided at the branching point. In contrast, the thermostat closes below the temperature threshold and prevents a flow of coolant into the second cooling duct through the engine block. Therefore, during a heating phase the cooling is limited to the cylinder head, while afterward, from the time when the temperature threshold is exceeded, there is also a flow of coolant through the engine block, which is therefore cooled.

In these combustion engines which are known from the prior art, the coolant flows which occur during operation when warming up and afterward are predefined by the geometry and dimensioning of the corresponding cooling ducts which are already defined when the respective combustion engine is manufactured.

Against this background, the invention is based on the object of making available an internal combustion engine with a cooling system which is improved in comparison therewith.

This and other objects are achieved by an internal combustion engine according to embodiments of the invention and/or by a vehicle including such an internal combustion engine according to embodiments of the invention.

A first aspect of the invention relates to an internal combustion engine, in particular for a vehicle. The internal combustion engine has a crank casing, a cylinder head, a coolant feedline, a cooling duct branching junction, a first coolant duct which runs at least partially through the cylinder head, and a second coolant duct which runs at least partially through the crank casing. In this context, the coolant feedline is connected to the cooling duct branching junction in order to feed in a coolant, and the first coolant duct and the second coolant duct are each connected to the cooling duct branching junction in order to be supplied with the coolant by the latter. Provided at the cooling duct branching junction is a temperature-sensitive flow regulating device which is configured to variably set, over a range and as a function of the temperature, the ratio of the coolant volumetric flow from the cooling duct branching junction into the first coolant duct with respect to the coolant volumetric flow from the cooling duct branching junction into the second coolant duct.

The term "internal combustion engine" is to be understood in the sense of the invention as a combustion engine which converts chemical energy into mechanical work. In particular, spark-ignition engines and diesel engines are internal combustion engines within the sense of the invention, without being restricted thereto.

The term "vehicle" in the sense of the invention is to be understood as meaning any type of land vehicle which is driven by machine force. In particular, non-track-bound motor vehicles such as, for example, passenger cars (PKW), trucks (LKW), motorbikes or buses are respectively vehicles in the sense of the invention.

The term "crank casing" in the sense of the invention is to be understood as being a part of an internal combustion engine in which its cylinders are (at least partially) formed and which has the crankshaft bearing. The term "engine block" is often also used for a crank casing.

The term "cylinder head" in the sense of the invention is to be understood as being a further part of an internal combustion engine which closes off the combustion space of the internal combustion engine with respect to the crank casing. In particular, the cylinder head can also accommodate inlet ducts and outlet ducts and the valve control for the gas exchange processes, oil ducts for lubrication of the valve drive, and also coolant ducts in coolant-cooled engines, the spark plugs in spark-ignition engines, the injection valves in direct-injection spark ignition engines, or the injection nozzles and the glow plugs in diesel engines.

The term "cooling duct branching junction" in the sense of the invention is to be understood as a branching off of a coolant line, similarly to a fork junction or a switching point, into two or more different cooling ducts or cooling branches.

The term "flow regulating device" in the sense of the invention is to be understood as meaning an actuator device which can set the flow of a fluid medium, in particular of coolant, as a variable to be closed-loop or open-loop controlled, over an open-loop or closed-loop control range as a function of at least one manipulated variable. The manipulated variable can be, in particular, a temperature, in particular that of the medium, that of the flow regulating device itself or that of its surroundings. Correspondingly, the meaning of the term "regulate" extends here both to a "closed-loop control" as well as to "open-loop control" in the known sense of open-loop and closed-loop control technology. The medium can be, in particular, a medium which is liquid at the temperatures occurring during regular operation of the internal combustion engine. For example, said medium is composed essentially of water to which it is also possible to add additives, for example an antifreeze agent. Gaseous media are also possible, such as for example in the case of air cooling.

In the sense of the invention, the term "temperature-dependent" is to be understood as meaning, in particular, a dependence on the temperature of the coolant, of the flow regulating device or of its immediate surroundings, or of the cylinder head or of the crank casing.

In the sense of the invention, the term "coolant volumetric flow" or for short "coolant flow" is to be understood as meaning the fluid flow of a coolant, i.e., the directed movement of the coolant, in particular in a coolant duct. The strength of the coolant volumetric flow corresponds to the volume of coolant which flows through a defined cross-section, in particular, that of a coolant duct, per unit of time.

In the sense of the invention, the term "configured" is to be understood as meaning that the corresponding device is already configured or is settable—i.e., configurable—to perform a specific function. The configuration can take place here, for example, by correspondingly setting parameters of a process sequence or of switches or the like in order to activate or deactivate functionalities or settings.

It is therefore possible to use the flow regulating device to variably set the splitting of a coolant flow, fed through the coolant feedline, at the cooling duct branching junction, as a function of the temperature, with the result that different ratios between the coolant volume flows into the various cooling branches are produced as a result thereof. However, in contrast to the known combustion engines described above, this ratio can be set variably and is not restricted to merely connecting or disconnecting the coolant flow into the coolant duct which runs through the crank casing. This permits the cooling of the cylinder head and crank casing to be set in an improved way, in particular in a way which is adapted more precisely to the actual temperature conditions at the internal combustion engine. It is therefore possible, in particular during the warming up of the internal combustion engine, to achieve cooling which is adapted continuously or at least in multiple stages to the actual temperature profile, and therefore to bring about an improvement in the reduction in friction in the internal combustion engine and therefore also to bring about an improvement in the fuel consumption.

Preferred embodiments of the internal combustion engine and developments thereof which, unless specifically excluded, can be randomly combined with one another and with the second aspect of the invention described below, are described in the following.

According to a first preferred embodiment, the flow regulating device is configured to regulate the ratio of the coolant volumetric flows into the first coolant duct and the second coolant duct in such a way that as the temperature rises, the ratio decreases to a minimum value. In this way, at a low temperature the coolant volumetric flow is increasingly directed into the first coolant duct through the cylinder head, while the crank casing is cooled only to relatively small extent by way of a coolant volumetric flow through the second coolant duct. If the temperature rises over time as a manipulated variable of the flow regulating device, this shifts the ratio of the coolant volumetric flows over a range in favor of the second coolant duct, with the result that the crank casing which has then already been heated is then also increasingly cooled, in order to counteract overheating of said crank casing. The minimum value is preferably between 2:1 and 8:1, particularly preferably between 3:1 and 5:1.

According to preferred developments of this embodiment, the flow regulating device is configured to regulate the ratio in such a way that as the temperature of the flow regulating device rises, the decrease in the ratio takes place continuously, in a plurality of essentially discrete steps, or according to a combination of the two. In this way, the granularity for the setting of the coolant volumetric flow ratio can be adapted to the requirements of the internal combustion engine.

According to a further preferred embodiment, the flow regulating device has a thermostatic valve. This may be, in particular, a material-based thermostatic valve which regulates the coolant flow at the cooling duct branching junction as a function of the thermally induced volume expansion of a material, in particular of a wax, over a regulating range. This permits easy setting of the ratio of the coolant volumetric flows by way of a single component, i.e., the thermostatic valve.

According to a further preferred embodiment, the flow regulating device is configured in such a way that when a specific pressure threshold is exceeded in the second coolant duct, the ratio decreases. In this way, it is also possible to trigger a reduction in the ratio solely or essentially by an overpressure with respect to the pressure threshold, independently of the temperature-induced change in said ratio. A relevant application case could, in particular, take the form of avoiding overheating of the crank casing, in particular in the region of the cylinders, if the internal combustion engine is already very highly loaded during the warming up, while it has not yet entirely reached its operational temperature. This may be the case, for example, in the case of high rotational speeds when still cold such as can occur, in particular, in the cold time of year or in the case of driving at a high speed (e.g., highway driving) without an appreciable warming up phase and with a relatively low load.

According to one preferred development of this embodiment, the flow regulating device is mounted in the cooling duct branching junction by way of a spring whose spring force is selected such that when the pressure applied to the flow regulating device from the second coolant duct exceeds the pressure threshold, the spring is deflected in such a way that at least part of the flow regulating device is moved by virtue of the fact that the ratio decreases. In this way, a purely passive overpressure regulating device or mechanism can be made available which, in particular, requires no additional pressure sensors or control devices and can therefore be implemented economically in terms of space and costs and with low complexity and a high level of robustness.

According to a further preferred embodiment, the flow regulating device can be operated autonomously, in particular independently of an electrical power supply or actuation device. In this way, external feedlines or communication connections for supplying energy and/or actuation device can be dispensed with, which can in turn contribute to implementation which is favorable in terms of space and costs and has a low complexity and easy replaceability. The temperature detection is then carried out directly by the flow regulating device. The above-mentioned material-based thermostatic valve can be embodied without an external electrical power supply and without an actuation device, in order thereby to provide a possible device or mechanism of implementing such an autonomous flow regulating device.

According to an alternative embodiment to this, the flow regulating device can be actuated externally by way of a signal, wherein the signal causes the flow regulating device to change the ratio or to set it to a specific value or to assume a specific setting for this purpose. The actuation device can, in particular, also be a regulating device or can be controlled with the characteristic curve.

According to a further preferred embodiment, the flow regulating device has a heating element with which the flow regulating device can be heated. In this way, the flow regulating device can also be brought to a desired operating temperature independently of its heating by the coolant flow in the cooling duct branching junction. This can serve, in particular, to pre-heat the flow regulating device briefly after the internal combustion engine starts, with the result that the temperature of said internal combustion engine is somewhat in advance of the coolant temperature. In this way, the thermal-capacity-induced inertia during the heating of the flow regulating device can be countered by the coolant. This can additionally contribute to avoiding overheating of the crank casing, in particular in the region of the cylinder, since the pre-heated flow regulating device can react with only a short delay to an increase in temperature of the coolant to a temperature range at which a reduction of the ratio is to take place. According to one preferred development, the heating element can also be used in conjunction with the embodiment described above in order to be actuated or regulated by way of a signal and thereby set, in particular as a function of characteristic curves, the setting of the flow regulating device and therefore the ratio of the cooling flows.

According to a further preferred embodiment, the flow regulating device has a first component and a second component which are coupled, so as to be movable with respect to each other, by way of an expansion element which expands as a function of the temperature. The second component is directly or indirectly supported on a wall of the internal combustion engine. The flow regulating device is configured and arranged here in such a way that the first component at least partially closes a connecting region from the coolant feedline to the second coolant duct at a temperature of the expansion element below a specific temperature threshold. Further, the flow regulating device is configured in such a way that when there is a rise in temperature of the expansion element to a temperature above the temperature threshold, the second component is shifted relative to the first component, owing to the expansion of the expansion element caused by the rise in temperature, in such a way that said first component is as a result moved at least partially out of the connecting region. In this way, an effective and also autonomous mechanical implementation of the flow regulating device is made possible. The above-mentioned heating element can optionally also be added, and the above-mentioned overpressure protection is possible in this embodiment.

In one preferred development of this embodiment, provided in the internal combustion engine is an enclosed cavity which is closed by the first component and into which said first component is at least partially moved when the expansion element expands. In this way, on the one hand a movability of the first component, which is necessary for functional reasons, is realized in a structurally simple fashion and, on the other hand, if the cavity is filled with a compressible medium, in particular air, said cavity can also serve as an additional suspension which applies to the first component a force which is opposed to the movement of said first component, and therefore assists the return movement thereof when said first component is to be moved again in the direction of the connecting region, in particular in the case of a reduction in temperature or pressure.

According to a further preferred embodiment, the internal combustion engine also has a coolant pump, wherein the coolant delivery capacity of the coolant pump is regulated as a function of the temperature, in particular as a function of the coolant temperature at the coolant pump or at the location of a temperature sensor on the cooling system, in such a way that its delivery rate increases at least in certain sections when the temperature rises. In this way, the variation of the ratio of the coolant volumetric flows can be combined with a variation of the overall available coolant volumetric flow through the coolant feedline. In this way, it is possible, for example in the cold state of the internal combustion engine when a high degree of cooling is not necessary for the cylinder head or for the crank casing, to reduce the power of the pump, and therefore the coolant volumetric flow in the coolant feedline in order to save energy, and at the same an optimized ratio of the coolant volumetric flows can be set by way of the flow regulating device. If the temperature of the internal combustion engine then rises, in addition to changing the ratio of the coolant volumetric flows into the first and second coolant ducts, it is also possible to increase the overall coolant volumetric flow in the coolant feedline, in order thereby to make available the higher overall cooling performance which is then necessary.

According to a further preferred embodiment, the flow regulating device is arranged at least partially in a cavity which is formed in the crank casing or in the cylinder head or in both together. In particular, the cavity can already be formed as a cutout during the manufacture of the internal combustion engine, in particular by casting. However, in addition it is also possible for the cavity to be embodied in the form of a drilled hole in the cylinder head or the crank casing or both. The arrangement of the flow regulating device in such a cavity permits a compact design of the internal combustion engine and in-situ positioning of the flow regulating device at the cooling duct branching junction if the latter is itself embodied as a cavity in the cylinder head, in the crank casing or in both together.

According to preferred variants of this embodiment, the cavity is defined at least partially by a drilled hole or cutout which extends from an outer surface of the crank casing or of the cylinder head into said crank casing or cylinder head. This facilitates the mounting of the flow regulating device since the latter can also be inserted subsequently into the internal combustion engine, in particular if the cylinder head and crank casing are already connected.

According to a further preferred embodiment, at least two of the following elements of the internal combustion engine are embodied in an integral fashion; the coolant feedline, the cooling duct branching junction, the first coolant duct, and the second coolant duct. This can be achieved, in particular, by virtue of the fact that the integrally embodied elements are embodied as a cavity in the crank casing or in the cylinder head or both together. In this way, transitions between the elements can be dispensed with, as a result of which the fabrication complexity and the susceptibility to leaks can be reduced or avoided.

According to a further preferred embodiment, the internal combustion engine has a plurality of cylinders which are grouped into a multiplicity of cylinder banks. A coolant feedline, a cooling duct branching junction, a first coolant duct which runs at least partially through the cylinder head in the region of the respective cylinder bank, and a second coolant duct which runs at least partially through the crank casing in the region of the respective cylinder bank are provided for each of at least two of the cylinder banks. The respective coolant feedline is connected to the respective cooling duct branching junction in order to feed in a coolant, and the respective first coolant duct and the respective second coolant duct are connected to the respective cooling duct branching junction in order to be supplied with the coolant from the latter. In this context, provided at the respective cooling duct branching junction is a temperature-sensitive flow regulating device which is configured to regulate, as a function of the temperature, the ratio of the coolant volumetric flow from the cooling duct branching junction into the respective first coolant duct with respect to the coolant volumetric flow from the respective cooling duct branching junction into the respective second coolant duct. In this way, not only is it possible to carry out splitting of the coolant circuit of the internal combustion engine with respect to a first cooling duct through the cylinder head and to a second duct through the crank casing, it is also possible to make available a plurality of such split partial circuits which cool various cylinder banks of the internal combustion engine. The variable setting of the cooling ratio between the cylinder head and crank casing can therefore be combined with splitting of the total coolant volumetric flow in the cooling system at various cylinder banks of the internal combustion engine, and the desired cooling effect can therefore be made available uniformly even when there are a plurality of cylinder banks.

A second aspect of the invention relates to a vehicle, in particular a motor vehicle, having an internal combustion engine according to the first aspect of the invention, in particular according to any of its above-mentioned embodiments and developments.

What has been respectively stated above with respect to the internal combustion engine also applies equally to the vehicle with such an internal combustion engine.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
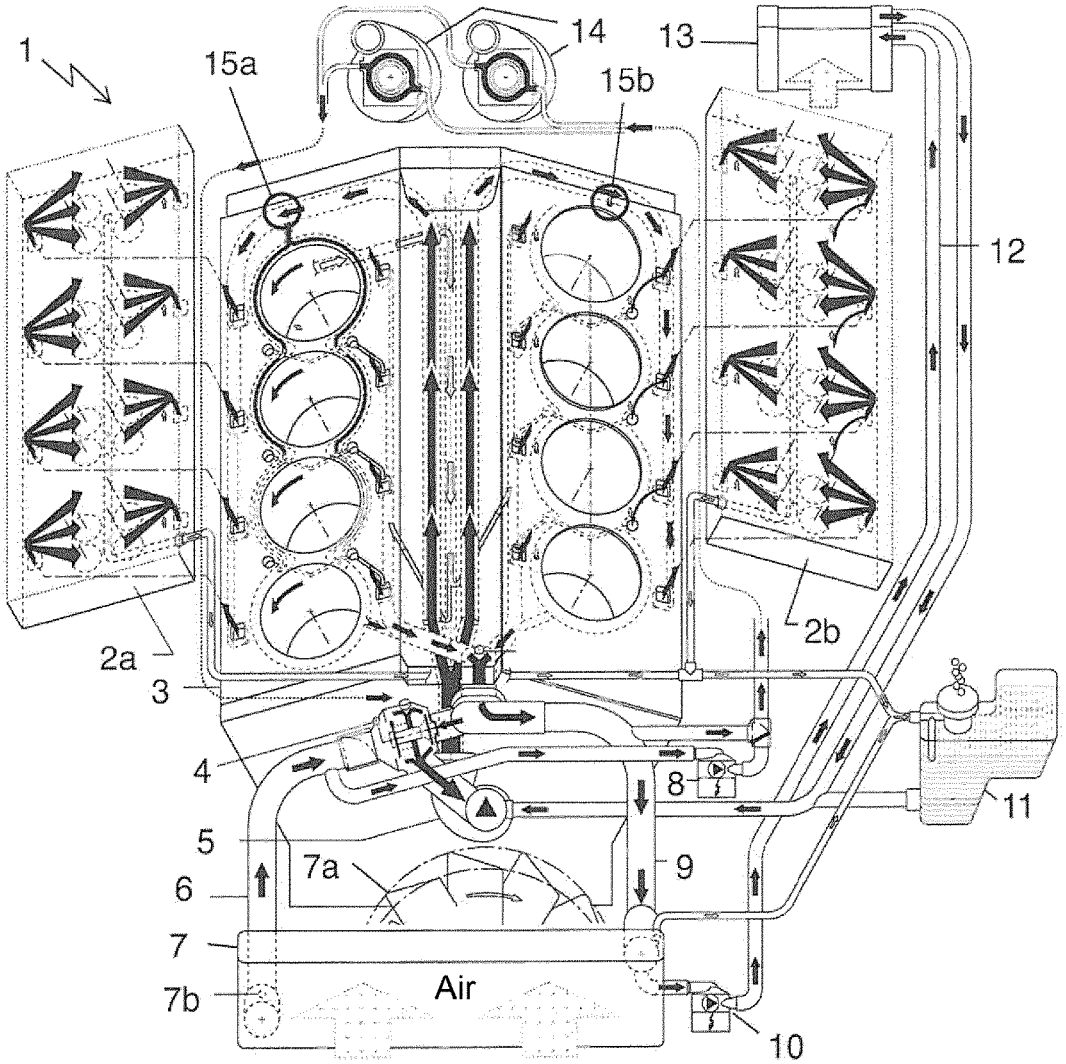
FIG. 1 is a schematic view of an internal combustion engine having two cylinder banks according to a preferred embodiment of the invention, wherein the respective cooling duct branching junction is marked for each of the cylinder banks.

Firstly, reference will be made to FIG. 1. An internal combustion engine 1 is embodied as a combustion engine for a vehicle and has a crank casing 3 which is structured in two cylinder banks which run parallel to each other and each have four cylinders. These cylinders are closed off per cylinder bank by a cylinder head 2*a* or 2*b* in each case. The cylinder heads 2*a*, 2*b* can also be embodied integrally as one part which closes off all the cylinders of the internal combustion engine 1. The crank casing 3 and the cylinder heads 2*a*, 2*b* have coolant lines or coolant ducts, by way of which a cooling circuit through the internal combustion engine 1 which is driven by a coolant pump 5 and in which a coolant circulates is made available. The flow of the coolant during operation is illustrated, starting from the coolant pump 5, by arrows along the coolant lines, wherein the arrows starting from the coolant pump 5 characterize the feeding of a cold coolant into the crank casing 3 and the cylinder heads 2*a*, 2*b*, while the arrows which lead out from said regions characterize the return flow of the coolant heated by the activity of the internal combustion engine 1. At the marked points 15*a*, 15*b*, there are cooling duct branching junctions at which the coolant flow which is provided by the coolant pump 5 through coolant feedlines is split into a first coolant duct, which runs through the respective cylinder head 2*a* or 2*b*, and a second coolant duct, which runs through the crank casing 3 along the cylinder walls of the respective cylinder bank. In order to cool the heated coolant, as customary a cooler 7 is provided, to which the heated coolant is fed along a cooler forward flow duct 9. By way of example, an air cooler with an additional fan 7*a* and with a temperature sensor 7*b* for detecting the cooler temperature is shown. The coolant which is cooled down again and comes from the cooler 7 via a cooler return flow duct 6 is fed to a cooling fluid thermostatic motor 4 which depending on the temperature opens the cooler partial circuit (at temperatures above a temperature threshold) or keeps it closed (at temperatures below this temperature threshold, in particular during warming up). In addition, an optional heating circuit 12 for heating the passenger cell of the vehicle is provided on the cooler partial circuit, which heating circuit 12 has a pump 10 for pumping the heated coolant through the heating circuit 12, and a heating heat exchanger 13 for heating the heating air for the passenger cell. Furthermore, overall an equalizing container 11 for making available and buffering coolant is preferably provided for the coolant circuit. Finally, the internal combustion engine 1 optionally also has two exhaust gas turbochargers 14 which are coupled by way of a further pump 8 to a run-on duct which branches off from the cooler return flow duct 6.

Figure 2:
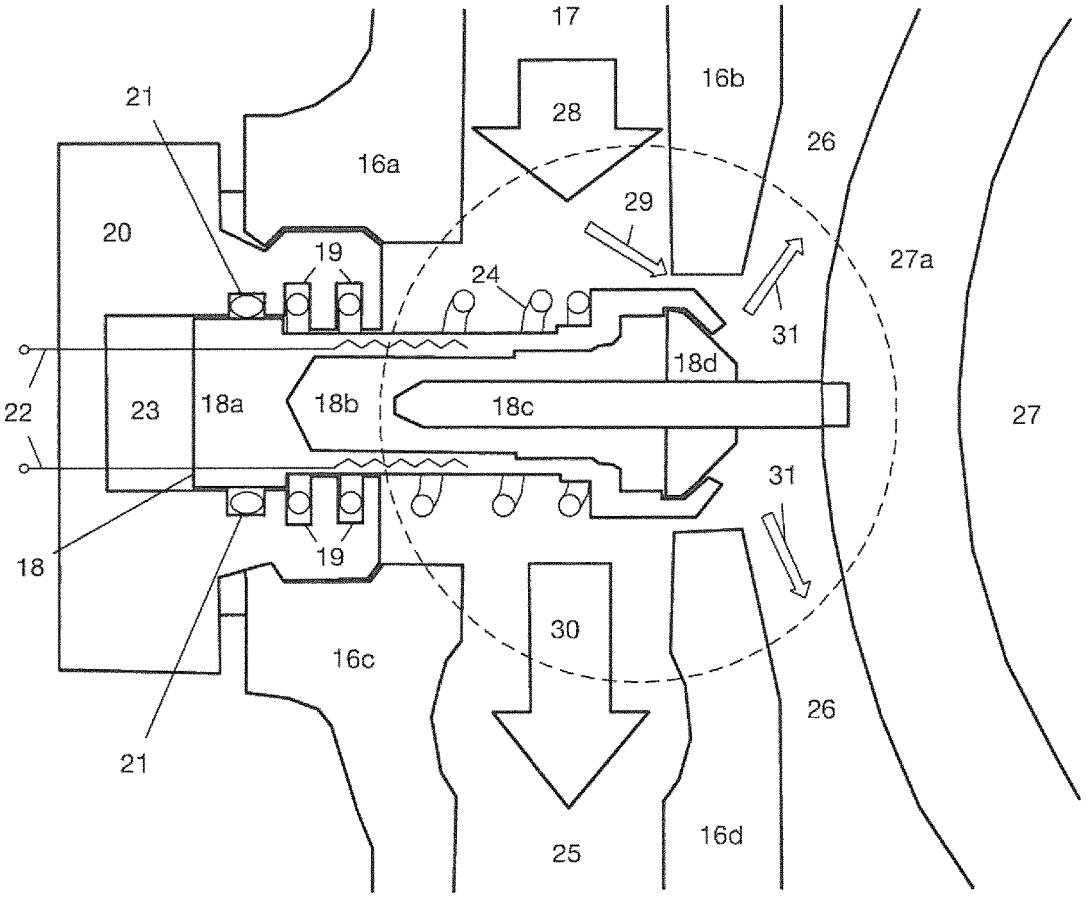
FIG. 2 is a schematic view of a section of the crank casing of the internal combustion engine in FIG. 1 in the region of one of the cooling duct branching junctions with a thermostatic valve as a flow regulating device.

FIG. 2 illustrates the region about the cooling duct branching junction 15 (or 15*a* in FIG. 1) once more in a schematic fashion in an enlargement and in greater detail. The same arrangement applies in a mirror-inverted fashion for the second cooling duct branching junction 15*b*. The coolant feedline 17, which comes from the coolant pump 5 in FIG. 1 and is bounded by the wall regions 16*a*, 16*b* of the crank housing in the surroundings of the cooling duct branching junction 15, serves to provide cooled coolant to the cooling duct branching junction 15 which is marked by the dashed-line circuit. At this cooling duct branching junction 15, the coolant flow 28 from the coolant feedline 17 splits into a first coolant volumetric flow 30 and a second coolant volumetric flow 31. The coolant flows are each characterized by corresponding arrows. The first coolant volumetric flow 30 flows into the first coolant duct 25, which is bounded by the wall regions 16*c*, 16*d* of the crank casing and leads on through the respective cylinder head 2*a* or 2*b* in FIG. 1 and serves to cool the latter. The second coolant volume flow 31 is, in contrast, branched off laterally (on the right) along the obliquely running black arrows and runs into a second coolant duct 26, which is bounded by the wall regions 16*b* and 16*d* of the crank casing and a wall 27*a* of a first cylinder 27, along the wall 27*a* of the first cylinder 27 and those of the other cylinders (not shown here) of the same cylinder bank and serves to cool them.

Provided in the cooling duct branching junction 15 is a flow regulating device 18 which can be embodied, in particular, in the form of a thermostatic valve, as illustrated here. The coolant from the coolant feedline 17 flows at least partially around said flow regulating device 18, with the result that it is in a heat-exchanging relationship therewith. The flow regulating device 18 is secured by a wall closure 20 which is guided through a drilled hole in the crank casing wall, between the wall regions 16*a*, 16*b* thereof. The arrangement of the flow regulating device 18 in a drilled hole which is accessible from the outside makes it possible, when mounting the internal combustion engine 1, to perform mounting even after the joining of the crank casing 3 and the cylinder heads 2*a*, 2*b* or to perform a simple replacement subsequently, for example in the case of a spare part repair. The flow regulating device 18 is configured to change its length along its longitudinal axis as a function of the temperature. For this purpose, said flow regulating device 18 has a first component 18*a* which has a receptacle for an expansion element 18*b* and a second component 18*c*. The expansion element 18*b*, which can have, in particular, a wax or a wax-like material, is arranged at least partially between the first component 18*a* and the second component 18*c*, with the result that when the expansion element 18*b* expands owing to the temperature, the two components 18*a* and 18*c* are moved relative to each other, in particular are shifted with respect to each other along the longitudinal direction of the flow regulating device 18, with the result that a temperature-dependent change in length of the flow regulating device 18 occurs. The second component 18*c* is supported with its outer end on the crank casing 3, in particular on the wall 27*a* of the first cylinder 27. For this purpose, a recess or some other attachment geometry or attachment device can also be provided at the supporting point. Therefore, when expansion occurs only the first component 18*a* moves relative to the crank casing in the direction of the wall closure 20.

Furthermore, the flow regulating device 18 has a closure element 18*d* which is mechanically coupled to the first component 18*a*, or is embodied as part thereof, and which closes the receptacle of the first component 18*a*. The first component 18*a* and the closure element 18*d* are arranged and shaped in such a way that in a first state of the flow regulating device 18, in which it reaches its largest longitudinal expansion, they close the connecting region, defined by an opening between the two wall regions 16*b* and 16*d* of the crank casing, from the coolant feedline 17 into the second coolant duct 26, at least partially and preferably predominantly. As a result, in the first state, the cross-section of the connecting region is typically reduced by more than 90%, preferably by more than 95%, with respect to its entirely opened second state in which the flow regulating device 18 has its smallest longitudinal expansion. If no complete seal is achieved here, in the second state a small residual coolant flow 29 from the coolant feedline 17 into the second coolant duct 27 remains. This can be advantageous, in particular, for making available a pressure equalization between the coolant feedline 17 and the second coolant duct 26.

The flow regulating device 18 also has a spring 24 which is fastened in at least one cutout 19 in the wall closure 20 and applies a spring force to the first component 18*a* with respect to the wall closure 20 and therefore the outer wall of the internal combustion engine 1, which spring force is directed such that it applies a force to the first component of the wall closure 20 in the direction of the connecting region to the second coolant duct. In the wall closure 20, a closed-off cavity 23 which is filled with air or some other suitable gas is formed directly adjoining the flow regulating device 18, into which cavity 23 the flow regulating device 18 can move if a sufficiently high pressing force is applied to it, which pressing force exceeds the opposing cumulated forces of the spring 24 and of the cavity 23 which acts as a gas spring. This may be the case if, in particular as a result of high loading of the internal combustion engine 1 during warming up, the temperature of the coolant in the second coolant duct rises, and therefore the pressure rises above a specific pressure threshold and a correspondingly high pressing force is applied to the end side, directed toward the connecting region, of the first component 18*a*, in particular to the closure element 18*d*. This may also be carried out, in particular, by way of the above-mentioned pressure equalization using the residual coolant flow 29 if the high pressure already occurs in the coolant feedline 17 and therefore is also established in the second cooling duct 26. The spring forces of the spring 24 and of the gas spring of the cavity 23 are matched in such a way that together they provide a spring force which defines a specific pressure threshold above which the first component 18*a* can move into and the cavity 23, with the result that the second component 18*c* moves back at least partially out of the connecting region, as a result of which the access to the second coolant duct is opened or widened and therefore the ratio of the first coolant flow and the second coolant flow is reduced. In this way, an overpressure protection which is at least largely independent of the temperature of the coolant in the coolant feedline 17 or the flow regulating device 18 is made available with respect to a specific pressure threshold for the crank casing 3, in particular in the region of its first cylinder 27 and the subsequently arranged, further cylinders. In order to provide a seal between the cavity 23 and the first component 18*a*, a seal 21 is also provided which is embodied, in particular, as an O-ring and can be arranged in an annular depression on the inside of the wall closure 20.

Finally, the flow regulating device 18 also has a heating element 22, with the aid of which it is heated at least largely independently of the temperature of the coolant and can be preheated, in particular during warming up.

While at least one exemplary embodiment has been described above, it is to be noted that there are a large number of variations thereof. It is also to be noted here that the described exemplary embodiments constitute only non-limiting examples and it is not intended thereby to restrict the scope, the range of application or the configuration of the devices and methods described here. Instead, the above description will provide a person skilled in the art with an introduction to the implementation of at least one exemplary embodiment, in which case it is to be understood that various modifications in the method of functioning and the arrangement of the elements described in an exemplary embodiment can be made without in doing so departing from the subject matter which is respectively defined in the appended claims or its legal equivalents.

LIST OF REFERENCE NUMBERS

1 Internal combustion engine
2*a,b* Cylinder head for a cylinder bank
3 Crank casing
4 Cooling fluid thermostatic motor
5 Coolant pump
6 Cooler return flow section
7 Cooler
7*a* Fan
7*b* Temperature sensor for cooler
8 Pump for exhaust gas turbocharger circuit
9 Cooler forward flow section
10 Pump for heating circuit
11 Equalizing container
12 Heating circuit
13 Heat exchanger for heating
14 Exhaust gas turbocharger
15, 15*a*, 15*b* Cooling duct branching junction
16*a-d* Wall regions of the crank casing
17 Coolant feedline
18 Flow regulating device, in particular thermostatic valve
18*a* First component of the flow regulating device
18*b* Expansion element of the flow regulating device
18*c* Second component of the flow regulating device
18*d* Closure element of the flow regulating device
19 Cutout/cutouts
20 Wall closure
21 Seal, in particular O-ring
22 Heating element of the flow regulating device
23 Cavity, in particular acting as gas spring
24 Spring of the flow regulating device
25 First coolant duct for cylinder head
26 Second coolant duct for crank casing
27 First cylinder
27*a* Wall of the first cylinder
28 Coolant flow in the coolant feedline
29 Residual coolant flow
30 First coolant (volumetric) flow
31 Second coolant (volumetric) flow

What is claimed is:

1. An internal combustion engine, comprising:
a crank casing;
a cylinder head;
a coolant feedline;
a cooling duct branching junction;
a first coolant duct which runs at least partially through the cylinder head; and
a second coolant duct which runs at least partially through the crank casing, wherein
the coolant feedline is connected to the cooling duct branching junction in order to feed in a coolant,
the first coolant duct and the second coolant duct are each connected to the cooling duct branching junction in order to be supplied with the coolant by the cooling duct branching junction,
a flow regulating device is provided at the cooling duct branching junction and is configured to variably set, over a range and as a function of temperature, a ratio of a first coolant volumetric flow from the cooling duct branching junction into the first coolant duct to a second coolant volumetric flow from the cooling duct branching junction into the second coolant duct, and
the flow regulating device is configured in such a way that when a specific pressure threshold is exceeded in the second coolant duct, the ratio decreases.

2. The internal combustion engine according to claim 1, wherein
the flow regulating device is configured to regulate the ratio of the first coolant volumetric flow into the first coolant duct to the second coolant volumetric flow into the second coolant duct in such a way that as the temperature rises, the ratio decreases to a minimum value.

3. The internal combustion engine according to claim 2, wherein
the flow regulating device is configured to regulate the ratio in such a way that as the temperature of the flow regulating device rises, the decrease in the ratio takes place continuously, in a plurality of essentially discrete steps, or according to a combination of the two.

4. The internal combustion engine according to claim 2, wherein the minimum value of the ratio is between 2:1 and 8:1.

5. The internal combustion engine according to claim 3, wherein the minimum value of the ratio is between 3:1 and 5:1.

6. The internal combustion engine according to claim 5, wherein
the flow regulating device is configured in such a way that when a specific pressure threshold is exceeded in the second coolant duct, the ratio decreases.

7. The internal combustion engine according to claim 1, wherein
the flow regulating device is mounted in the cooling duct branching junction by way of a spring whose spring force is selected in such a way that when a pressure applied to the flow regulating device from the second coolant duct exceeds the pressure threshold, the spring is deflected in such a way that at least part of the flow regulating device is moved by virtue of the fact that the ratio decreases.

8. The internal combustion engine according to claim 1, wherein the flow regulating device is autonomously operable.

9. The internal combustion engine according to claim 1, wherein the flow regulating device has a heating element with which the flow regulating device is heatable.

10. The internal combustion engine according to claim 1, wherein
the flow regulating device has a first component and a second component which are coupled, so as to be movable with respect to each other, by way of an expansion element which expands as a function of the temperature, wherein the second component is supported on a wall of the internal combustion engine, and the flow regulating device is configured and arranged in such a way that:

the first component at least partially closes a connecting region from the coolant feedline to the second coolant duct at a temperature of the expansion element below a specific temperature threshold; and when there is a rise in temperature of the expansion element to a temperature above the temperature threshold, the second component is shifted relative to the first component, owing to the expansion of the expansion element caused by the rise in temperature, in such a way that the first component is, as a result, moved at least partially out of the connecting region.

11. The internal combustion engine according to claim 7, wherein the flow regulating device has a first component and a second component which are coupled, so as to be movable with respect to each other, by way of an expansion element which expands as a function of the temperature, wherein the second component is supported on a wall of the internal combustion engine, and the flow regulating device is configured and arranged in such a way that:

the first component at least partially closes a connecting region from the coolant feedline to the second coolant duct at a temperature of the expansion element below a specific temperature threshold; and when there is a rise in temperature of the expansion element to a temperature above the temperature threshold, the second component is shifted relative to the first component, owing to the expansion of the expansion element caused by the rise in temperature, in such a way that the first component is, as a result, moved at least partially out of the connecting region.

12. The internal combustion engine according to claim 10, further comprising:

an enclosed cavity in the internal combustion engine, which cavity is closed by the first component and into which the first component is at least partially moved when the expansion element expands.

13. The internal combustion engine according to claim 1, further comprising:

a coolant pump, wherein a coolant delivery capacity of the coolant pump is regulated as a function of the temperature in such a way that its delivery rate increases at least in certain sections when the temperature rises.

14. The internal combustion engine according to claim 1, wherein the flow regulating device is arranged at least partially in a cavity which is formed in the crank casing or in the cylinder head or in both together.

15. The internal combustion engine according to claim 14, wherein the cavity is defined at least partially by a drilled hole or cutout which extends from an outer surface of the crank casing or of the cylinder head into the crank casing or cylinder head.

16. The internal combustion engine according to claim 1, further comprising:

a plurality of cylinders which are grouped into a multiplicity of cylinder banks, wherein the coolant feedline, the cooling duct branching junction, the first coolant duct which runs at least partially through the cylinder head in a region of the respective cylinder bank, and the second coolant duct which runs at least partially through the crank casing in the region of the respective cylinder bank are provided for each of at least two of the cylinder banks, and the respective coolant feedline is connected to the respective cooling duct branching junction in order to feed in a coolant, and the respective first coolant duct and the respective second coolant duct are connected to the respective cooling duct branching junction in order to be supplied with the coolant from the latter, wherein provided on the respective cooling duct branching junction is a temperature-sensitive flow regulating device which is configured to regulate, as a function of the temperature, the ratio of the coolant volumetric flow from the cooling duct branching junction into the respective first coolant duct with respect to the coolant volumetric flow from the respective cooling duct branching junction into the respective second coolant duct.

17. The internal combustion engine according to claim 11, further comprising:

a plurality of cylinders which are grouped into a multiplicity of cylinder banks, wherein the coolant feedline, the cooling duct branching junction, the first coolant duct which runs at least partially through the cylinder head in a region of the respective cylinder bank, and the second coolant duct which runs at least partially through the crank casing in the region of the respective cylinder bank are provided for each of at least two of the cylinder banks, and the respective coolant feedline is connected to the respective cooling duct branching junction in order to feed in a coolant, and the respective first coolant duct and the respective second coolant duct are connected to the respective cooling duct branching junction in order to be supplied with the coolant from the latter, wherein provided on the respective cooling duct branching junction is a temperature-sensitive flow regulating device which is configured to regulate, as a function of the temperature, the ratio of the coolant volumetric flow from the cooling duct branching junction into the respective first coolant duct with respect to the coolant volumetric flow from the respective cooling duct branching junction into the respective second coolant duct.

18. The internal combustion engine according to claim 1, wherein the internal combustion engine is for a vehicle.

19. A vehicle, comprising:

an internal combustion engine according to claim 1.

* * * * *